US006506492B1

(12) United States Patent
Foulger

(10) Patent No.: US 6,506,492 B1
(45) **Date of Patent: *Jan. 14, 2003**

(54) SEMICONDUCTIVE JACKET FOR CABLE AND CABLE JACKETED THEREWITH

(75) Inventor: Stephen H. Foulger, Lexington, SC (US)

(73) Assignee: Pirelli Cables & Systems, LLC, Columbia, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/306,735

(22) Filed: May 7, 1999

Related U.S. Application Data

(63) Continuation-in-part of application No. 09/113,914, filed on Jul. 10, 1998.

(51) Int. Cl.[7] ..... D02G 3/00; H01C 1/02; H01B 7/00

(52) U.S. Cl. ..... 428/372; 428/379; 428/383; 252/511; 174/110 PM; 174/120 SR; 524/495

(58) Field of Search ..... 252/511; 428/372, 428/379, 383; 174/110 PM, 120 SR; 524/495, 524, 514, 508

(56) References Cited

U.S. PATENT DOCUMENTS

| | | | |
|---|---|---|---|
| 3,735,025 | A | 5/1973 | Ling et al. |
| 4,265,789 | A | 5/1981 | Christopherson et al. |

(List continued on next page.)

FOREIGN PATENT DOCUMENTS

| | | |
|---|---|---|
| EP | 524 700 | 3/1988 |
| EP | 337 487 | 4/1989 |
| WO | WO 98/03578 | 7/1997 |

OTHER PUBLICATIONS

European Search Report No. RS 101469 dated Oct. 16, 1998.

European Search Report No. EP 99 30 5464 dated Aug. 24, 1999.

Graham, Gordon et al., *Insulating and Semiconductive Jackets for medium and High Voltage Underground Power Cable Applications, IEEE Electrical Insulation Magazine,* vol. 11, No. 5 (Sep./Oct. 1995), pp. 5–12.

(List continued on next page.)

*Primary Examiner*—Cynthia H. Kelly
*Assistant Examiner*—J. M. Gray
(74) *Attorney, Agent, or Firm*—Norris, McLaughlin & Marcus

(57) ABSTRACT

A conductive polymer composite material for semiconductive jackets for cables which has a significant reduction in conductive filler content while maintaining the required conductivity and mechanical properties specified by industry. Materials and processing approaches are selected to reduce the percolation threshold of the conductive filler in the composite, while balancing the material selection with the industry-required mechanical properties of the semiconductive jacket. The semiconductive jacket material comprises a minor phase material which is a semicrystalline polymer; a conductive filler material dispersed in the minor phase material in an amount sufficient to be equal to or greater than an amount required to generate a continuous conductive network in the minor phase material; and a major phase material which is a polymer which when mixed with the minor phase material will not engage in electrostatic interactions that promote miscibility. The major phase material has the minor phase material dispersed therein in an amount sufficient to be equal to or greater than an amount required to generate a continuous conductive network in the major phase material, forming a semiconductive jacket material of a ternary composite having distinct co-continuous phases.

25 Claims, 2 Drawing Sheets

U.S. PATENT DOCUMENTS

| | | | | | |
|---|---|---|---|---|---|
| 4,400,580 | A | | 8/1983 | Yamanouchi et al. | |
| 4,412,938 | A | | 11/1983 | Kakizaki et al. | |
| 4,451,536 | A | * | 5/1984 | Barlow et al. | 428/383 |
| 4,626,618 | A | | 12/1986 | Takaoka et al. | |
| 4,929,388 | A | | 5/1990 | Wessling | |
| 5,004,561 | A | | 4/1991 | Nomura et al. | |
| 5,037,999 | A | | 8/1991 | VanDeusen | |
| 5,174,924 | A | | 12/1992 | Yamada et al. | |
| 5,246,783 | A | | 9/1993 | Spenadel et al. | |
| 5,281,757 | A | | 1/1994 | Marin et al. | |
| 5,556,697 | A | | 9/1996 | Flenniken | |
| 5,844,037 | A | * | 12/1998 | Lungard et al. | 524/496 |
| 6,197,219 | B1 | * | 3/2001 | Foulger | 252/500 |
| 6,277,303 | B1 | * | 8/2001 | Foulger | 252/500 |
| 6,284,832 | B1 | * | 9/2001 | Foulger et al. | 524/496 |
| 6,331,353 | B1 | * | 12/2001 | Foulger | 428/379 |
| 6,331,585 | B1 | | 12/2001 | Thielen et al. | 524/401 |
| 6,417,265 | B1 | * | 7/2002 | Foulger | 524/495 |

OTHER PUBLICATIONS

Narkis, Moshe, *Structuring and Special Effects in Polymer Systems Containing Carbon Black,* Undated.

Gubbles, F et al., *Design of Electrical Conductive Composites: Key Role of the Morphology on the Electrical Properties of carbon Black Filled Polymer Blends, Macromolecules,* vol. 28, No. 5 (1995), pp. 1559–1566.

Tchoudakov, R., et al., *Conductive Polymer Blends with Low Carbon Black Loading: Polypropylene/Polyamide, Polymer Engineering and Science,* vol. 36, No. 10 (May 1996), pp. 1336–1346.

Kirkpatrick, Scott, *Percolation and Conduction, Reviews of Modern Physics,* vol. 45, No. 4 (Oct. 1973), pp. 574–588.

Lux, F., *Review Models Proposed to Explain the Electrical Conductivity of Mixtures Made of Conductive and Insulating Materials, Journal of Materials Science,* vol. 28 (1993), pp. 285–301.

Sherman, R.D., et al., *Electron Transport Processes in Conductor–Filled Polymers, Polymer Engineering and Science,* vol. 23, No. 1 (Jan., 1983) pp. 36–46.

Narkis, M., et al., *Resistivity Behavior of Filled Electrically Conductive Crosslinked Polyethylene, Journal of Applied Polymer Science,* vol. 29 (1984), pp. 1639–1652.

Narkis, M. et al., *Segregated Structures in Electrically Conductive Immiscible Polymer Blends,* ANTEC '95, pp. 1343–1346.

Breuer, O., et al., *Segregated Structures in carbon Black–Containing Immiscible Polymer Blends: HIPS/LLPDE Systems*, Undated.

Levon, Kalle, et al., *Multiple Percolation in Conducting Polymer Blends, Macromolecules,* vol. 26, No. 15 (1993), pp. 4061–4063.

Gubbels, F., et al., *Selective Localization of Carbon Black in Immiscible Polymer Blends: A Useful Tool to Design Electrical Conductive Composites, Macromolecules,* vol. 27, No. 7 (1994), pp 1972–1974.

Kozlowski, M., *Electrically Conductive Structured Polymer Blends, Polymer Networks & Blends,* vol. 5, No. 4 (1995), pp. 163–172.

Tang, H., et al., *Electrical Behavior of Carbon Black–Filled Polymer Composites: Effect of Interaction Between Filler and Matrix, Journal of Applied Polymer Science,* vol. 51, No. 7 (Feb. 1994), pp. 1159–1164.

* cited by examiner

SEMICONDUCTIVE JACKET FOR CABLE AND CABLE JACKETED THEREWITH

CROSS REFERENCE TO RELATED APPLICATION

This is a continuation-in-part of application Ser. No. 09/113,914 filed Jul. 10, 1998 pending.

FIELD OF INVENTION

The present invention relates generally to cables, and more particularly to compositions suitable for semiconductive jackets especially for medium and high voltage power cables and cables jacketed therewith.

BACKGROUND OF THE INVENTION

Electric power cables for medium and high voltages typically include a core electrical conductor, an overlaying semiconductive shield, an insulation layer formed over the semiconductive shield, an outermost insulation shield, and some type of metallic component. The metallic component may include, for example, a lead sheath, a longitudinally applied corrugated copper tape with overlapped seam, or helically applied wires, tapes, or flat strips. U.S. Pat. No. 5,281,757 assigned to the current assignee, and U.S. Pat. No. 5,246,783, the contents of both of which are herein incorporated by reference, disclose examples of electric power cables and methods of making the same.

Electric power cables for medium and high voltage applications also typically include an overall extruded plastic jacket which physically protects the cable thereby extending the useful life of the cable. The afore-described overall jacket may be insulating or semiconducting. If the overall jacket is insulating, it may overlay or encapsulate the metallic component of the cable as discussed in the September/October 1995 Vol. 11, No. 5, IEEE Electrical Insulation Magazine article, entitled, *Insulating and Semiconductive Jackets for Medium and High Voltage Underground Power Cable Applications,* the contents of which are herein incorporated by reference.

According to the National Electrical Safety Code, power cables employing insulating jackets must be grounded every 0.125 to 0.25 mile depending on the application, or at every splice for cable in duct (at every manhole). Such grounding reduces or eliminates the losses in a cable system. Furthermore, as the neutral to ground voltage may be very high, such grounding is also required for safety purposes.

In contrast to insulating jackets, semiconductive jackets are advantageously grounded throughout the length of the cable and therefore do not need periodic grounding previously described. Accordingly, semiconductive jackets are only grounded at the transformer and at the termination.

Although semiconductive jackets are advantageous for the foregoing reasons, they are not widely employed in the power cable industry. Prior art semiconductive jacket materials were usually not developed for jacketing applications, and as such, often do not meet performance criteria for long-life cable protection.

The Insulated Cable Engineers Association (ICEA) specifies in ICEA S-94-649-1997, "Semiconducting Jacket Type 1", mechanical properties for semiconductive electrical cable jackets and references American Society for Testing and Materials (ASTM) test methods to test materials suitable for these applications.

Prior art semiconductive jackets, even if they do meet performance criteria for long-life cable protection, are often cost prohibitive for widespread industry employment. This high cost is primarily due to the high weight percentage of conductive additive necessary in the jacket material to make the jacket semiconductive. Typically this weight percentage is greater than 15 to 30 weight percent to achieve the required conductivity or volume resistivity for the jacket. See, for example, U.S. Pat. No. 3,735,025, the contents of which are herein incorporated by reference, which discloses an electric cable jacketed with a thermoplastic semiconducting composition comprising chlorinated polyethylene, ethylene ethyl acrylate, and 30 to 75 or 40 to 60 parts by weight of semiconducting carbon black.

Prior art polymer compounds used in the role of a semiconductive jackets are normally thermoplastic and get their conductivity by use of a large weight percentage of a conductive filler material, usually conductive grades of carbon black, to incur a high level of conductivity (or low level of resistivity), to the compound. The National Electrical Safety Code (Section 354D2-c) requires a radial resistivity of the semiconducting jacket to be not more than 100Ω·m and shall remain essentially stable in service. Prior art compositions required loadings of conductive filler material of at least about 15% to 60% by weight to achieve this criteria. These high levels of conductive filler material inherently add significantly to the cost of such compositions, inhibit the ease of extrusion of the jacketing composition, and decrease the mechanical flexibility of the resultant cable.

Percolation theory is relatively successful in modeling the general conductivity characteristics of conducting polymer composite (CPC) materials by predicting the convergence of conducting particles to distances at which the transfer of charge carriers between them becomes probable. The percolation threshold ($p_c$), which is the level at which a minor phase material is just sufficiently incorporated volumetrically into a major phase material resulting in both phases being co-continuous, that is, the lowest concentration of conducting particles needed to form continuous conducting chains when incorporated into another material, can be determined from the experimentally determined dependence of conductivity of the CPC material on the filler concentration. For a general discussion on percolation theory, see the October 1973 Vol. 45, No. 4, Review of Moderm Physics article, entitled, *Percolation and Conduction,* the contents of which are herein incorporated by reference. Much work has been done on determining the parameters influencing the percolation threshold with regard to conductive filler material. See for example, *Models Proposed to Explain the Electrical Conductivity of Mixtures Made of Conductive and Insulating Materials,* 1993 Journal of Materials Science, Vol. 28; *Resistivity of Filled Electrically Conductive Crosslinked Polyethylene,* 1984 Journal of Applied Polymer Science, Vol. 29; and *Electron Transport Processes in Conductor-Filled Polymers,* 1983 Polymer Engineering and Science Vol. 23, No. 1; the contents of each of which are herein incorporated by reference. See also, *Multiple Percolation in Conducting Polymer Blends,* 1993 Macromolecules Vol. 26, which discusses "double percolation", the contents of which are also herein incorporated by reference.

Attempts for the reduction of conductive filler content in CPC materials have been reported for polyethylene/polystyrene and for polypropylene/polyamide, both employing carbon black as the conductive filler. See *Design of Electrical Conductive Composites: Key role of the Morphology on the Electrical Properties of Carbon Black Filled Polymer Blends,* 1995 Macromolecules, Vol. 28 No. 5 and *Conductive Polymer Blends with Low Carbon Black Loading: Polypropylene/Polyamide,* 1996 Polymer Engineering and Science, Vol. 36, No. 10, the contents of both of which are herein incorporated by reference.

However, none of the prior art concerned with minimizing the conductive filler content has addressed materials suitable for use as a semiconductive jacket material for cables which must meet not only the electrical requirements, but also stringent mechanical requirements as discussed heretofore.

What is needed, and apparently lacking in the art is a semiconductive jacket material which has a significant reduction of conductive filler material, thereby decreasing the cost of the material and the processing by increasing the ease of extrusion and mechanical flexibility of the jacketed cable, while maintaining industry performance criteria for resistivity and mechanical properties.

SUMMARY OF THE INVENTION

The present invention provides a conductive polymer composite (CPC) material for semiconductive jackets for cables which has a significant reduction in conductive filler content while maintaining the required conductivity and mechanical properties specified by industry by selecting materials and processing approaches to reduce the percolation threshold of the conductive filler in the composite, while balancing the material selection with the industry required mechanical properties of the semiconductive jacket.

The present inventive semiconductive jackets for cables share certain attributes with U.S. application Ser. No. 09/113,963 (presently allowed, pending issuance), entitled, *Conductive Polymer Composite Materials And Methods of Making Same,* filed on an even date with the parent of this application, Jul. 10, 1998, by the same applicant, the contents of which are herein incorporated by reference. That is, the semiconductive jacket materials of the present invention are based on immiscible polymer blends wherein the immiscibility is exploited to create semiconductive compounds with low content conductive filler through a multiple percolation approach to network formation. The conductive filler material content can be reduced to about 10% by weight. of the total composite or less, depending on the conductive filler material itself and the selection of major and minor phase materials, without a corresponding loss in the conductivity performance of the compound. Correspondingly, the rheology of the melt phase of the inventive material will more closely follow an unfilled system due to the reduction of the reinforcing conductive filler content thereby increasing the ease of processing the material.

Semiconductive jackets for power cables must have a conductive network throughout the material. The physics of network formation of a minor second phase material in a differing major phase is effectively described by percolation theory as discussed heretofore. The "percolation threshold" ($p_c$) is the level at which a minor phase material is just sufficiently incorporated volumetrically into a major phase material resulting in both phases being co-continuous, that is, the lowest concentration of conducting particles needed to form continuous conducting chains when incorporated into another material. A minor second phase material in the form of nonassociating spheres, when dispersed in a major phase material, must often be in excess of approximately 16% by volume to generate an infinite network. This 16 volume % threshold, which is exemplary for spheres, is dependent on the geometry of the conductive filler particles, (i.e. the surface area to volume ratio of the particle) and may vary with the type of filler. The addition of a single dispersion of conductor filler particles to a single major phase is termed "single percolation". It has been found that by altering the morphology of the minor/major phase a significant reduction in percolation threshold can be realized. The present invention exploits these aspects of percolation theory in developing very low conductive filler content semiconductive jacket materials for cables.

In accordance with the present invention, a method requiring an immiscible blend of at least two polymers that phase separate into two continuous morphologies is employed. By requiring the conductive filler to reside in the minor polymer phase, the concentration of conductive filler can be concentrated above the percolation threshold required to generate a continuous conductive network in the minor polymer phase while the total concentration of conductive filler in the volume of the combined polymers is far below the threshold if the filler was dispersed uniformly throughout both phases. In addition, since the minor polymer phase is co-continuous within the major polymer phase, the concentration is conductive. This approach employs multiple percolation due to the two levels of percolation that are required: percolation of conductive dispersion in a minor phase and percolation of a minor phase in a major phase.

In a binary mixture of a semicrystalline polymer and a conductive filler, the filler particles are rejected from the crystalline regions into the amorphous regions upon recrystallization, which accordingly decreases the percolation threshold. Similarly, using a polymer blend with immiscible polymers which results in dual phases as the matrix in CPC materials promotes phase inhomogeneities and lowers the percolation threshold. The conductive filler is heterogeneously distributed within the polymers in this latter example. In one alternative of this approach, either one of the two polymer phases is continuous and conductive filler particles are localized in the continuous phase. In a second alternative, the two phases are co-continuous and the filler is preferably in the minor phase or at the interface.

The present invention concentrates primarily on two aspects of percolation phenomenon: the interaction of the conductive dispersion in the minor phase, and the interaction of the minor phase with the major phase. Further, the foregoing approach as disclosed in the afore-referenced U.S. application Ser. No. 09/113,963 (presently allowed, pending issuance), entitled, *Conductive Polymer Composite Materials and Methods of Making Same* may be employed and has been optimized and balanced for semiconductive jacket applications.

In accordance with one aspect of the present invention, a semiconductive jacket material for jacketing a cable comprises: a minor phase material comprising a semicrystalline polymer; a conductive filler material dispersed in said minor phase material in an amount sufficient to be equal to or greater than an amount required to generate a continuous conductive network in said minor phase material; and a major phase material, said major phase material being a polymer which when mixed with said minor phase material will not engage in electrostatic interactions that promote miscibility, said major phase material having said minor phase material dispersed therein in an amount sufficient to be equal to or greater than an amount required to generate a continuous conductive network in said major phase material, forming a semiconductive jacket material of a ternary composite having distinct co-continuous phases.

In accordance with another aspect of the present invention, the ternary composite has a volume resistivity of about $\leqq 100\Omega\cdot m$, an unaged tensile strength of at least about 1200 psi, a tensile strength of at least about 75% of said unaged tensile strength after aging in an air oven at 100° C. for 48 hours, an aged and unaged elongation at break of at least about 100%, a heat distortion at 90° C. of at least about −25%, and a brittleness temperature of about ≦10° C.

In accordance with another aspect of the present invention, the conductive filler material comprises about ≦10 percent by weight of total conducting polymer composite weight.

In accordance with yet another aspect of the present invention, the semiconductive jacket material further comprises a second major phase material, wherein said ternary composite is dispersed in an amount sufficient for said ternary composite to be continuous within said second major phase material, said second major phase material being selected from a group of polymers which when mixed with said ternary composite will not engage in electrostatic interactions that promote miscibility with said minor phase material or said major phase material, forming a semiconductive jacket material of a quaternary composite having distinct co-continuous phases.

In accordance with a further aspect of the present invention, a method of producing a semiconductive jacket material for jacketing a cable comprises: mixing a semicrystalline polymer having a melting temperature in a mixer, said mixer preheated to above the melting temperature of said semicrystalline polymer; adding a conductive filler material to said semicrystalline polymer in said mixer in an amount ≧an amount required to generate a continuous conductive network in said semicrystalline polymer; mixing said conductive filler material and said semicrystalline for a time and at a speed sufficient to insure a uniform distribution of said conductive filler in said semicrystalline polymer, thereby forming a binary composite; and mixing a major phase material having a melting temperature with said binary composite in said mixer preheated to above the melting temperature of said major phase material, for a time and at a speed sufficient to insure a uniform distribution of said binary composite in said major phase material, such that a weight ratio of said binary composite to said major phase material is sufficient for said binary composite to be ≧an amount required to generate a continuous conductive network in said major phase material, said major phase material being selected from a group of polymers which when mixed with said binary composite will not engage in electrostatic interactions that promote miscibility, such that a semiconductive jacket material of a ternary composite with distinct co-continuous phases is formed.

In accordance with yet a further aspect of the present invention, a method of producing a semiconductive jacket material for jacketing a cable comprises: mixing a semicrystalline minor phase polymer material with a conductive filler material, the conductive filler material being in an amount sufficient to be equal to or greater than an amount required to generate a continuous conductive network within the minor phase polymer material, thereby forming a binary composite; mixing the binary composite with a major phase polymer material to form a semiconductive jacket material of a ternary composite having distinct phases; and annealing the ternary composite to coarsen the morphology and thereby further increase conductivity of the jacket material, said major phase polymer material being selected from a group of polymers which when mixed with said binary composite will not engage in electrostatic interactions that promote miscibility, such that a semiconductive ternary composite with distinct co-continuous phases is formed.

In accordance with yet a further aspect of the present invention, a method of producing a semiconductive jacket material for jacketing a cable comprises: mixing a semicrystalline minor phase polymer material having a melting temperature with a conductive filler material, the conductive filler material being in an amount sufficient to be equal to or greater than an amount required to generate a continuous conductive network within the minor phase polymer material, thereby forming a binary composite; annealing the binary composite; and mixing the binary composite with a major phase material at a temperature below the melting temperature of the binary composite, said major phase polymer material being selected from a group of polymers which when mixed with said binary composite will not engage in electrostatic interactions that promote miscibility, thereby forming a semiconductive jacket material of a ternary composite having distinct co-continuous phases.

Still further in accordance with the present invention, a method of producing a semiconductive jacket material for jacketing a cable comprises: mixing a semicrystalline minor phase polymer material with a conductive filler material, the conductive filler material being in an amount sufficient to be equal to or greater than an amount required to generate a continuous conductive network within the minor phase polymer material, thereby forming a binary composite; mixing the binary composite with a major phase polymer material to form a ternary composite; mixing the ternary composite with a second major phase polymer material to form a semiconductive jacket material of a quaternary composite having distinct phases; and annealing the quaternary composite to coarsen the morphology and thereby further increase the conductivity of the jacket material, said major phase polymer material being selected from a group of polymers which when mixed with said binary composite will not engage in electrostatic interactions that promote miscibility, such that a semiconductive ternary composite with distinct co-continuous phases is formed.

In further accordance with the present invention, a cable comprises at least one transmission medium and a semiconductive jacket surrounding said transmission medium, said semiconductive jacket comprising: a minor phase material comprising a semicrystalline polymer; a conductive filler material dispersed in said minor phase material in an amount sufficient to be equal to or greater than an amount required to generate a continuous conductive network in said minor phase material; and a major phase material, said major phase material being a polymer which when mixed with said minor phase material will not engage in electrostatic interactions that promote miscibility, said major phase material having said minor phase material dispersed therein in an amount sufficient to be equal to or greater than an amount required to generate a continuous conductive network in said major phase material, forming a semiconductive jacket material of a ternary composite having distinct co-continuous phases.

In general, the superior results of the present invention may be achieved by allowing the conductive filler material to reside in a minor phase of the immiscible blend; the minor phase being a semicrystalline polymer having a relatively high crystallinity, such as between about 30% and about 80%, and preferably about ≧70%, thereby causing the conductive filler aggregates to concentrate in amorphous regions of the minor phase or at the interface of the continuous minor and major phases. Annealing processes of the composite at different points in the mixing process or modifying the morphology of the minor phase can further increase the crystalline phase or further coarsen the morphology of the blend and thereby improve the conductive network.

In accordance with the present invention, in order that a favorable phase morphology, that is, phase separation, develops between minor and major phase materials, the minor and major phase materials must be such that when mixed, the minor and major phase polymeric materials do not engage in electrostatic interactions that promote miscibility resulting in a negative enthalpy of mixing. Thus, hydrogen bonding does not occur between any of the phases and there is phase separation between all of the phases. Furthermore, the solubility parameter difference ($\delta_A-\delta_B$) of the minor and major phase materials in the ternary composites of the present invention meet the following criteria for immiscibility:

$$U_L \geqq (\delta_A-\delta_b)^2 \geqq 0$$

Where, $U_L$=7, more preferably 5;

$\delta_A$=the solubility parameter of the minor phase material; and $\delta_B$=the solubility parameter of the major phase material.

The Hoftyzer-Van Krevelen definition of solubility parameter has been adopted. See, D. W. Van Krevelen, "Properties of Polymers", Third Edition, Elsevier Science B.V., Amsterdam, 1990; the contents of which are herein incorporated by reference.

An advantage of the present invention includes the reduction of conductive filler material content in a semiconductive cable jacket to less than about 6 weight percent of total composite weight without a corresponding loss in the conductivity performance of the jacket.

Yet another advantage of the present invention is the ability to produce a semiconductive cable jacket which satisfies the ICEA S-94-649-1997 "Semiconducting Jacket Type 1" specification requirements.

Yet another advantage is the cost reduction due to the reduced conductive filler content and ease of processing over conventional semiconducting jackets.

BRIEF DESCRIPTION OF THE DRAWINGS

Other objects, features and advantages of the present invention will be apparent from the following detailed description of the presently preferred embodiments in conjunction with the accompanying drawings in which.

DETAILED DESCRIPTION OF THE INVENTION

Figure 1:
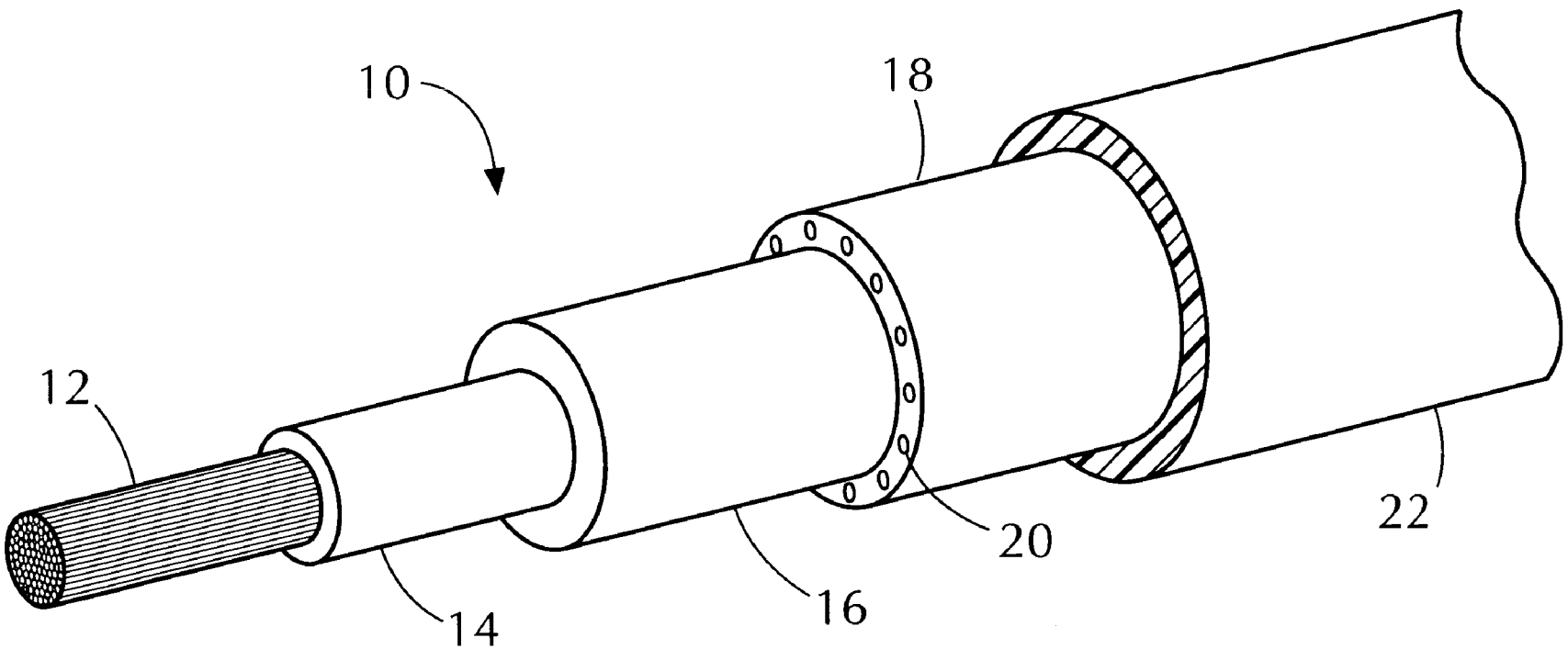
FIG. 1 depicts a portion of an electrical cable jacketed with the semiconductive jacket of the invention.

Semiconductive jacket material for cables having good conductivity with significant reduction of conductive filler content of the present invention are based on a conductive filler dispersed in a minor phase material, forming a binary composite; the binary composite being mixed with at least one major phase polymeric material. More specifically, the present invention may be achieved by adhering to the hereinafter discussed four general principles and alternate hereinafter described embodiments. (1) The conductive filler content is preferably at or just greater than the percolation threshold in the minor phase material (i.e. the lowest concentration of conductive filler content required to generate a continuous conductive network in the minor phase material); (2) the minor phase content is at or just greater than the percolation threshold in the major phase material (i.e. the lowest concentration of minor phase material required to generate a continuous conductive network in the major phase material); (3) the minor phase material is semicrystalline; and (4) the major/minor phase blend is immiscible having distinct phases.

In accordance with one embodiment of the present invention, a semiconductive jacket material for jacketing a cable, said semiconductive jacket material comprises: a minor phase material comprising a semicrystalline polymer; a conductive filler material dispersed in said minor phase material in an amount sufficient to be equal to or greater than an amount required to generate a continuous conductive network in said minor phase material; and a major phase material, said major phase material being a polymer which when mixed with said minor phase material will not engage in electrostatic interactions that promote miscibility, said major phase material having said minor phase material dispersed therein in an amount sufficient to be equal to or greater than an amount required to generate a continuous conductive network in said major phase material, forming a semiconductive jacket material of a ternary composite having distinct co-continuous phases.

The material chosen for the conductive filler in any of the embodiments of the present invention influences the amount of conductive filler required to meet or exceed the percolation threshold to form a conductive network. The conductive filler material may be any suitable material exhibiting conductivity and should have a chemical structure which results in an inherently high conductivity and an affinity to develop a strong network. The conductive filler material may, for example, be selected from the group consisting of carbon black (CB), graphite, metallic particles, intrinsically conductive polymers, carbon fibers, and mixtures thereof. In particular, the CB may be an "acetylene black" or a "furnace black" or any commercial grade of conductive CB, the acetylene blacks being superior in producing conductive blends. Exemplary CBs are also disclosed in U.S. Pat. No. 5,556,697, the contents of which are herein incorporated by reference. "Furnace blacks" are lower quality CBs and are inferior in their ability to produce conductive blends when compared to "acetylene blacks", which are fabricated from the pyrolysis of acetylene. Therefore "acetylene blacks" are most preferred in the present invention over other CB types. Intrinsically conductive polymers, such as polyacetylene, polyaniline, polypyrrole, mixtures thereof and the like, are also preferable for optimizing the reduction of conductive filler in the present invention and thus may also be employed as the conductive filler material. These polymers generally have conductivity's higher than that of even acetylene blacks, but are more costly. Also, carbon fibers or "whiskers" may be employed and will have a lower weight percent content than that of CB or intrinsically conductive polymers to exceed percolation threshold.

An important feature of the present invention is the low amount of conductive filler material employed while still maintaining a desired level of conductivity. The particular weight percent of conductive filler material employed is dependent upon the type of conductive filler material, and the type of minor phase material and major phase material. For non-metallic conductive filler materials, the conductive filler content can be as high as 10–12 percent by weight of the total composite. When metallic particles are employed as the conductive filler material, the weight percent may be quite high (85% or higher by weight of the total composite), while the volume fraction would be very low (<10%). One skilled in the art would recognize that such values may be determined experimentally for each set of chosen materials. An important criteria, however, is that it is an amount sufficient to meet or exceed the percolation threshold which varies depending upon the selected materials. For example, in the working example set forth hereinafter it may be seen that the minor phase material may be about 44% by weight high density polyethylene (HDPE); the conductive filler may be about ≦6% by weight furnace grade CB; and the major phase material may be about 50% by weight poly(ethylene-co-vinyl-acetate (EVA), the EVA having a vinyl acetate (VA) content of from about 12% to about 45% by weight. If an acetylene black or an intrinsically conductive polymer or carbon fiber is used as the conductive filler in this example, the conductive filler content may be ≦6% and preferably ≦about 4% by weight. Based on the foregoing and for example, the minor phase material may be from about 30% to about 50% by weight HDPE and the EVA may be from about 65% to about 50% by weight EVA depending on the VA content in the EVA.

As can be seen from the foregoing, material selection in each embodiment of the present invention is important in meeting the ICEA S-94-649-1997, "Semiconducting Jacket Type 1" specification for mechanical properties. For example, the minor phase material for each embodiment of the present invention must be semicrystalline in nature and the crystallinity may range from about 30% to about 80% and preferably ≧about 70% based on the heat of fusion of a perfect crystal. Suitable minor phase materials include any semicrystalline polymer such as HDPE, polypropylene, polypropene, poly-1-butene, poly(styrene) (PS), polycarbonate, poly(ethylene terephthalate), nylon 66, nylon 6 and mixtures thereof.

One skilled in the art would recognize that the level of minor phase material content required to meet or exceed the percolation threshold in the major phase material and to meet the required mechanical properties for semiconducting cable jackets is dependent on the constituents of the system, such as the conductive filler material and major phase material(s), and the description and the examples set forth herein should serve as a guide. For example, it has been found that for an HDPE/EVA/CB system with a VA content of 40% that the minor phase HDPE/CB should be about ≧45% and preferably 50% to meet the mechanical properties required in a suitable jacket material, although less is needed to meet the electrical properties.

Suitable materials for the major phase material may be any polymeric material which meets the afore-described criteria for not engaging in electrostatic interactions that promote miscibility in relation to the heretofore described suitable minor phase materials. It should be noted that minor electrostatic interactions may be permissible within the above criteria as long as miscibility is not promoted. That is, the blend must be immiscible. Furthermore, the solubility parameter difference ($\delta_A-\delta_B$) of the minor and major phase materials in the ternary composites of the present invention meet the following criteria for immiscibility:

$$U_L \geqq (\delta_A-\delta_B)^2 \geqq 0$$

Where, $U_L$=7, more preferably 5;

$\delta_A$=the solubility parameter of the minor phase material; and $\delta_B$=the solubility parameter of the major phase material.

Suitable materials for the major phase material may include, for example, EVA, polybutylene terephthalate, PS, poly(methyl methacrylate) (PMMA), polyethylene, polypropylene, polyisobutylene, poly(vinyl chloride), poly (vinylidene chloride), poly(tetrafluoroethylene), poly(vinyl acetate), poly(methyl acrylate), polyacrylonitrile, polybutadiene, poly(ethylene terephthalate), poly(8-aminocaprylic acid), poly(hexamethylene adipamide) and mixtures thereof.

As indicated above, one skilled in the art will recognized that the selection and amount of major phase material employed is also dependent upon the constituents of the system, and the description and examples set forth herein should serve as a guide.

In furtherance to the above, exemplary major/minor pairs may include the following. That is, minor phase materials polyethylene, polypropene and poly- I -butene may be paired with major phase materials PS, poly(vinyl chloride), poly(vinylidene chloride), poly(tetrafluoroethylene), poly (vinyl acetate), poly(methyl acrylate), poly(methyl methacrylate), polyacrylonitrile, polybutadiene, poly (ethylene terephthalate), poly(8-aminocaprylic acid), poly (hexamethylene adipamide). Similarly, minor phase materials PS, polycarbonate, poly(ethylene terephthalate), nylon 66, nylon 6 may be paired with major phase materials polyethylene, polypropylene and polyisobutylene.

Another embodiment of the present invention employs a minor phase material of HDPE with a crystallinity of greater than about 70%, conductive filler of furnace grade CB and a major phase material of EVA. If the VA in the EVA is greater than about 40% by weight, the HDPE/CB minor phase material with a 12% by weight conductive filler content in the minor phase material (which is about 6% by weight of total composite), should be equal to or in excess of about 50% by weight of the total composite to meet both conductivity and mechanical property criteria for semiconductive cable jackets. However, if the VA of the EVA is less than about 40% by weight, the EVA is more crystalline, and the level of HDPE/CB minor phase material may be less than about 50% by weight of the total composite provided that the HDPE/CB content is sufficient to exceed the percolation threshold required to generate a continuous conductive network in the EVA. Whether or not the HDPE/CB content is sufficient to exceed the percolation threshold required to generate a continuous conductive network in the EVA and meet the requirements for a semiconductive cable jacket may be verified experimentally by measuring the volume resistivity of the material. For example, a volume resistivity of ≦100Ω·m is required.

In accordance with another embodiment of the present invention, the semiconductive jacket material further comprises a second major phase material, wherein said ternary composite is dispersed in an amount sufficient for said ternary composite to be continuous within said second major phase material, said second major phase material being selected from a group of polymers which when mixed with said ternary composite will not engage in electrostatic interactions that promote miscibility with said minor phase material or said major phase material, forming a semiconductive jacket material of a quaternary composite having distinct co-continuous phases.

The second major phase material may be selected as described above for the previously discussed major phase material.

One skilled in the art would recognize that the amount of ternary composite sufficient for the ternary composite to be continuous within the second major phase material is dependent upon the constituents of the system and may be determined experimentally by measuring the volume resistivity as a function of ternary composite content to ensure that semiconductivity results.

It also should be noted that for quaternary blends, all four constituents (i.e. conductive filler, minor phase, and two major phases) must be mutually insoluble for the temperature and conditions of the material use.

In accordance with a further embodiment of the present invention, a method of producing a semiconductive jacket material for jacketing cables is disclosed. In this embodiment, a semicrystalline polymer having a melting temperature is mixed in a mixer, wherein the mixer is preheated to above the melting temperature of the semicrystalline polymer.

A conductive filler material is added to the semicrystalline polymer in the mixer in an amount ≧an amount required to generate a continuous conductive network in the semicrystalline polymer. For example, the conductive filler material may be added in an amount between about 0.1 weight percent and about 12 weight percent for a HDPE/EVA/CB system. However, one skilled in the art would recognize that the amount of conductive filler material employed is dependent upon the conductive filler material and the other particular constituents of the system.

The conductive filler material and semicrystalline polymer are conventionally mixed for a time and at a speed sufficient to insure a uniform distribution of the conductive filler in the semicrystalline polymer, thereby forming a binary composite.

A major phase material having a melting temperature is conventionally mixed with the binary composite in a mixer preheated to above the melting temperature of the major phase material, for a time and at a speed sufficient to insure a uniform distribution of said binary composite in the major phase material. The weight ratio of the binary composite to the major phase material is sufficient for the binary composite to be ≧an amount required to generate a continuous conductive network in the major phase material, the major phase material being selected from a group of polymers which when mixed with the binary composite will not engage in electrostatic interactions that promote miscibility, such that a semiconductive jacket material of a ternary composite with distinct co-continuous phases is formed.

For example, the following non-limiting parameters may be particularly employed: from about 0.1% by weight to about 10% by weight conductive filler; from about 49.9% by weight to about 44% by weight HDPE; and about 50% by weight EVA if VA is about 40% by weight.

The semicrystalline polymer may be selected from the afore-described minor phase materials and may be present in the amounts described therefor.

In accordance with a further embodiment of the present invention, a second major phase material having a melting temperature is conventionally mixed with the afore-described ternary composite in a mixer preheated to above the melting temperature of the second major phase material, for a time and at a speed sufficient to insure a uniform distribution of said ternary composite in the second major phase material. The weight ratio of the ternary composite to the second major phase material is sufficient for the ternary composite to be ≧the percolation threshold required to generate a continuous conductive network in the second major phase material, the second major phase material being selected from a group of polymers which when mixed with the ternary composite will not engage in electrostatic interactions that promote miscibility, such that a semiconductive jacket material of a quaternary composite with distinct co-continuous phases is formed. The second major phase material may be as previously described for the major phase material.

Thus, it can be seen that in accordance with the present invention, more than two phases can be blended to further reduce the conductive filler content by weight percent of the final composite. For example, preferably, the conductive filler content is just above percolation threshold in a minor phase material forming a binary composite. The binary composite is mixed just above the percolation threshold with a major phase material, forming a ternary composite. The ternary composite is mixed with a second major phase material just above the percolation threshold. A quaternary composite results which preferably has less than about 3% by weight conductive filler content with respect to the total quaternary composite weight, yet which forms a continuous conductive network in the composite. A requirement for this embodiment is that the resultant composite is an immiscible blend with distinct phases, and that the conductive filler is in the continuous minor phase. For example, a quaternary composite of the present invention could be formed with a minor phase of "furnace grade" CB in HDPE; the CB comprising about 3.6% by weight of the quaternary composite and about 26.4% by weight HDPE, the major phase material being about 30% by weight EVA and about 40% by weight PS. Of course other combinations meeting the requirements of the present invention will be apparent to those skilled in the art.

In a like manner, semiconductive jacket materials of the invention can be formed with more than two major phase materials. For example, the heretofore described quaternary composite may be mixed in an amount sufficient to exceed the amount required to generate a continuous conductive network with a third major phase material, said third major phase material being such that it will not engage in electrostatic interactions that promote miscibility with the second, first or minor phase materials. Thus the resultant composite is an immiscible blend with distinct phases. In accordance with the present invention, semiconductive composite materials may be formed by repeating the heretofore described mixing procedure with any number of further major phase materials which meet the requirements for major phase materials set forth heretofore such that the resultant semiconductive composite material is an immiscible polymer blend having distinct co-continuous phases.

The resulting composites of the present invention can be further enhanced by conventional annealing processes. That is, in accordance with a further embodiment of the present invention, the afore-described ternary composite, binary composite and/or quaternary composite may be annealed thereby coarsening the morphology of the respective composite. For example, the percolation threshold of the minor phase in the major phase may be further reduced by preferably annealing the final CPC composite from approximately just above the melting temperature of both the minor phase material and the major phase material. This results in reinforcing the phase separation between the major and minor phase materials by coarsening the morphology of the composite, and thus resulting in the formation of a CPC material with reduced conductive filler content which maintains good conductivity.

Alternately, according to the present invention, the percolation threshold of the conductive filler in the minor phase material can be reduced by annealing the minor phase/conductive filler composite before mixing in the major phase material. The annealing will result in the threshold concentration for forming conductive networks in the binary composite to be lower when employing semicrystalline polymers as the minor phase material, such as HDPE or isostatic polypropylene. During the crystallization process a major part of the conductive JO filler particles are rejected into interspherulitic boundaries and the remaining, non-rejected conductive filler particles may be located in amorphous regions within the spherulites, resulting in the heretofore described reduction in percolation threshold. Thus annealing of the foregoing minor phase/conductive filler composite refines and increases the crystalline phase. The afore-described binary composite may be annealed to below the binary composite's melting temperature prior to mixing the afore-described major phase material with the binary composite, wherein the second polymer has a melting temperature less than the binary composite's melting temperature. The major phase material and the binary composite being mixed at a temperature below the melting temperature of the binary composite.

In a further embodiment of the present invention, a reduction of the percolation threshold of the minor phase material in the major phase material may be achieved by modifying the surface area to volume ratio of the minor phase material, thereby increasing the minor phase's affinity to create a conductive network, before mixing the minor phase with the major phase material. This can be accomplished by pulverizing (i.e. crushing) the binary composite of minor phase material with conductive filler dispersed therein, or more preferably by extruding thread-like structures of binary composite as described below. The pulverized or thread-like structures of binary composite are then mixed with the major phase material below the melting temperature of the minor phase material. It is noted that one skilled in the art would readily know how to pulverize the afore-described material.

In further accordance with another embodiment of the present invention, the afore-described binary composite may be extruded into threadlike structures prior to mixing the major phase material with the binary composite, the major phase material having a melting temperature less than the binary composite's melting temperature, wherein the major phase material and the extruded threadlike structures of the binary composite are mixed at a temperature below the melting temperature of the binary composite. The threadlike structures may be, for example, about 2 mm long and about 0.25 mm in diameter and one skilled in the art would readily understand how to extrude the binary composite.

Referring now to FIG. 1, a semiconductive jacket of the invention, which may be a thermoplastic compound, is shown on an electrical cable 10. The electrical cable 10 comprises a central core conductor 12, an overlaying semiconductive conductor shield 14, at least one polymeric insulation layer 16 formed over the semiconductive conductor shield, a semiconductive insulation shield 18 formed over the insulation layer 16, and a metal component 20 which may be embedded in the semiconductive insulation shield 18 as shown, or may overlay the semiconductive insulation shield 18. A semiconductive jacket 22 is preferably extruded over the semiconductive insulation shield 18 by methods readily known to those skilled in the art.

Figure 2:
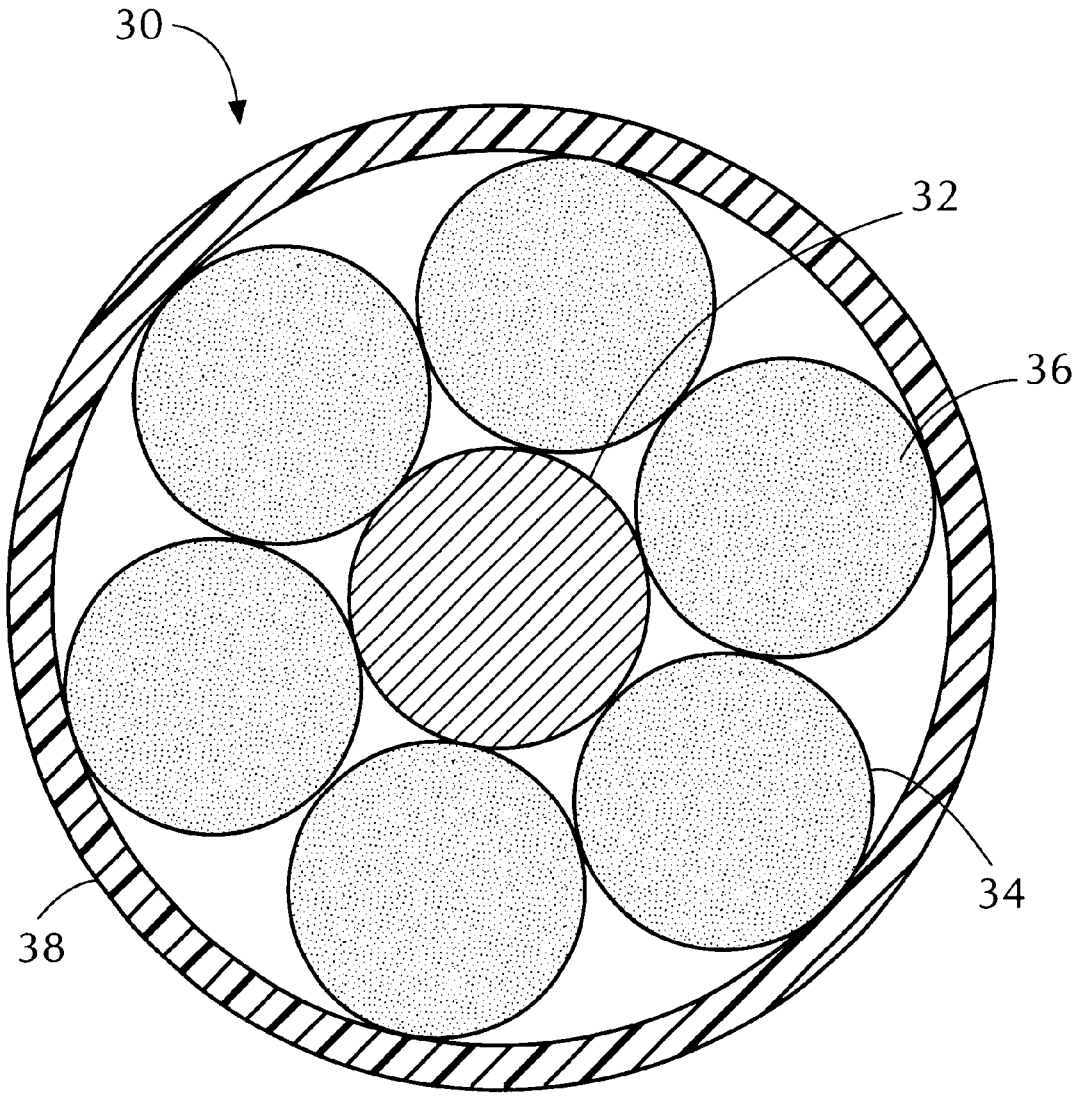
FIG. 2 depicts a portion of an optical fiber cable jacketed with the semiconductive jacket of the invention.

The semiconductive jacket may also be applied over an optical fiber cable as shown in FIG. 2 or a hybrid cable. Optical fiber cables and hybrid cables, (i.e. cables carrying electrical conductors and optical fiber), are often grounded periodically if they contain metallic elements, especially for lightening protection. Further, some optical fiber cables are installed by blowing them into ducts. Often in this process, depending on the duct material, a static charge builds up on the surface of the cable which opposes the charge on the duct, hindering installation. A semiconductive jacket of the present invention on these cables would advantageously dissipate the static charge and ease installation. In FIG. 2, the optical fiber cable 30 comprises a metallic central strength member 32, at least one tube 34 containing optical fibers 36, and a semiconductive jacket 38 formed around the tubes 34 preferably by extruding the semiconductive jacket 38 by methods readily known to those skilled in the art. A layer of armor, waterblocking material, and additional strength member material may be optionally included in the optical cable 30.

The principles of the invention can be further illustrated by the following non-limiting examples.

EXAMPLE 1

Suitable semiconductive jacket materials of the present invention were made using commercial grades of a random copolymer of EVA, HDPE, and furnace grade CB. In this example, the semiconductive jacket material is 6% by weight CB, 44% by weight HDPE, and 50% by weight EVA. The characteristics of the materials used in this example are set forth in Table 1. In particular, the EVA was selected to have a high concentration, 45% by weight, of VA in order to reinforce the phase separation between the minor phase material (HDPE/CB) and the major phase (EVA). EVA's with lower weight % VA are less preferable for increased conductivity, but could be substituted without departing from the general principles of the invention. The composite was mixed at 170° C. in a Brabender internal mixer with a 300 $cm^3$ cavity using a 40 rpm mixing rate. The mixing procedure for the semiconductive jacket material of the invention comprises adding the HDPE into the preheated rotating mixer and allowing the polymer to mix for 6 minutes. The CB is added to the mixing HDPE and is allowed to mix for an additional 9 minutes, which insures a uniform distribution of CB within the HDPE. The EVA is added and the mixture allowed to mix for an additional 10 minutes. The semiconductive jacket material, thus formed was then molded at a pressure of about 6 MPa for 12 minutes at 170° C. into a plaque of about 0.75 mm in thickness for testing.

TABLE 1

| Constituent | Tradename | Characteristics | Producer |
|---|---|---|---|
| EVA | LEVRAPREN ® | 45 weight % VA content | Bayer Corporation |
| HDPE | PETROLENE LS6081-00 | Density = 0.963 g/$cm^3$ | Millennium Chemical |
| CB | VULCAN XC72 | $N_2$ Surface Area = 254 $m^2$/g<br>DBP oil absorption = 174 $cm^3$/100 g<br>mean particle diameter = 300 Å | Cabot Corporation |

The electrical conductivity of the resultant composite was measured by cutting 101.6 mm×6.35 mm×1.8 mm strips from the molded plaque, and colloidal silver paint was used to fabricate electrodes 50 mm apart along the strips in order to remove the contact resistance. A Fluke 75 Series II digital multimeter and a 2 point technique was used to measure the electrical resistance of the strips.

Mechanical properties of the semiconductive jacket material were tested in accordance with ASTM D-638. Unaged and 2 day/100° C. aged mechanical properties (i.e. tensile strength and elongation at break) were determined for the semiconductive jacket material using dogbones cut from ASTM D470–ASTM D-412 Die C. The draw rate on the Instron Model 4206 tensile testing machine was at 2 inch/minute, and all measurements were conducted at 23° C. unless otherwise indicated.

In addition, the heat deformation for the semiconductive jacket material at 90° C. was tested in accordance with UL 1581 Section 560; this temperature is required for the ICEA S-94-649-1997 "Semiconducting Jacket Type 1" specification. This procedure calculates the deformation that a 2000 gram weight with a defined loading area imparts to a 24 mm×14 mm×1.52 mm specimen at a prescribed temperature.

The results of the electrical and mechanical property tests for the semiconductive jacket material of the invention for this example are set forth in Table 2.

TABLE 2

| Property | Industry Requirement | Semiconductive Jacket Material of the Invention |
|---|---|---|
| unaged tensile strength (minimum) | 1200 psi | 1172 ± 76[b] psi |
| aged[a] tensile strength (minimum) | 75% of unaged | 1090 ± 51[b] psi |
| unaged elongation at break (minimum) | 100% | 140% ± 24[b]% |
| aged[a] elongation at break (minimum) | 100% | 109% ± 19[b]% |
| heat distortion at 90° C. (minimum) | −25% | 1% |
| volume resistivity (maximum) | 100 Ω · m | 4.36 ± .48[b] Ω · m |
| brittleness temperature | ≦ −10° C. | < −10° C. |

[a]aged in an air oven at 100° C. for 48 hours.
[b]68% confidence levels.

As evident from Table 2, this example demonstrates the ability to make a semiconducting jacket with low conductive filler content that meets, within the margin of error, the "Semiconducting Jacket Type 1".

It would be expected that the use of an acetylene black or an intrinsically conductive polymer or carbon fiber in place of the furnace grade black used in the present example would result in a similar properties with <6 weight % and preferably <4 weight % conductive filler loading of the semiconductive jacket material.

EXAMPLE 2

Suitable semiconductive jacket materials of the present invention may be made using commercial grades of a random copolymer of EVA, HDPE, and furnace grade CB. In this example, the semiconductive jacket material is 6% by weight CB, 44% by weight HDPE, and 50% by weight EVA. The characteristics of the materials which may be used in this example are set forth in Table 3. In particular, the EVA is selected to have a lower concentration, 25% by weight, of VA than that of Example 1. While the higher VA content in Example 1 reinforces the phase separation between the minor phase material (HDPE/CB) and the major phase (EVA), which results in better conductivity of the resultant composite material. EVA's with lower weight % VA will have increased crystallinity which will enhance the mechanical properties of the resultant semiconductive material without a significant loss in conductivity. It is expected that the resistivity of the semiconductive jacket material of this example will be within industry specifications, that is ≦100Ω·m with improved tensile strength and elongation properties.

The composite is mixed at 170° C. in a Brabender internal mixer with a 300 $cm^3$ cavity using a 40 rpm mixing rate. The mixing procedure for the semiconductive jacket material of the invention comprises adding the HDPE into the preheated rotating mixer and allowing the polymer to mix for 6 minutes. The CB is added to the mixing HDPE and is allowed to mix for an additional 9 minutes, which insures a uniform distribution of CB within the HDPE. The EVA is added and the mixture allowed to mix for an additional 10 minutes. The semiconductive jacket material, thus formed is then molded at a pressure of about 6 MPa for 12 minutes at 170° C. into a plaque of about 0.75 mm in thickness.

TABLE 3

| Constituent | Tradename | Characteristics | Producer |
|---|---|---|---|
| EVA | ELVAX ® 360 | 25 weight % VA content | DuPont Company |
| HDPE | PETROLENE ® LS6081-00 | Density = 0.963 g/$cm^3$ | Millennium Chemical |
| CB | VULCAN ® XC72 | $N_2$ Surface Area = 254 $m^2$/g DBP oil absorption = 174 $cm^3$/100 g mean particle diameter = 300 Å | Cabot Corp. |

This example further demonstrates the ability to produce a CPC material having low conductive filler content, as well as enhanced physical properties.

EXAMPLE 3

In a further embodiment of the present invention, a quaternary immiscible blend may be formed using the constituents: PS, EVA, HDPE, and CB by the method comprising the steps set forth hereinafter.

The PS is added to the Brabender internal rotating mixer preheated to 170° C. and allowed to mix for about 6 minutes at 40 rpm, prior to the addition of the EVA/HDPE/CB ternary composite already prepared as, for instance, set forth in the foregoing examples. This blend is allowed to mix for an additional 9 minutes. The final quaternary composite is then molded at a pressure of about 6 MPa for 12 minutes at 170° C. in plaques of about 0.75 mm in thickness. In this example, the follow constituents may be employed: 3.6% by weight CB; 26.4% by weight HDPE; 30% by weight EVA; 40% by weight PS; and 40% by weight VA in the EVA.

In a multiple percolation like this heretofore described, it is important that the quaternary composite is an immiscible blend with distinct phases, and that the conductive filler is in the continuous phases. Thus, a CPC composite with less than about 4% by weight of CB of the total PS/EVA/HDPE/CB may be formed.

Thus, in accordance with the present invention and view of the examples and disclosures set forth herein, a CPC material having less than or equal to about 6% by weight conductive dispersion content of CB residing in a minor phase of HDPE is mixed with EVA. By modifying the level of HDPE in the EVA, crystallinity of HDPE, level of VA in the EVA copolymer, and CB content in the HDPE, a highly conductive compound may be generated with a resistivity of less than about 100Ω·m. In addition, due to the low levels of required CB to impart a high conductivity to the CPC material, the rheology of the compound is more analogous to an unfilled compound in terms of extrusion properties and processability. The CPC can be further tailored to meet the mechanical properties required for semiconductive cable jackets by modifying the level of VA in the EVA in further accordance with the present invention, as demonstrated in Example 2.

In further accordance with the present invention and in view of the foregoing, it can be seen that the afore-described advantages and superior results may be achieved by the selection of a conductive filler with a chemical structure which results in an inherently high conductivity and an affinity to develop a strong network, such as CB, and by the modification of the thermodynamic stability of the conductive filler and the minor polymer phases to encourage coarsening of the filler/minor phase morphology, such as by the afore-described annealing technique.

The advantages are also realized by selecting a minor phase polymer with a high level of crystallinity such that the conductive filler and minor phase material preferentially phase separate in order to increase the concentration of the conductive filler in the amorphous phase, as well as by reducing the percolation threshold of the minor phase/conductive filler material in the major phase material through a processing approach, such as the afore-described extruding, annealing and pulverizing means, to changing the morphology of the minor phase/conductive filler material.

The advantages are also realized by coarsening the morphology of the major/minor phase through modifying the thermodynamic stability of the polymer phases to promote immiscibility by selecting suitable minor/major pair materials.

As also described above, advantages of the present invention are achieved by post-annealing of the CPC material to coarsen the morphology of the major/minor phase, as well as by increasing the crystalline component of the major phase polymer; for example, modifying the VA content in the EVA as heretofore described or by incorporating 0.01% by weight to about 2% by weight of a nucleating agent in the major phase material to promote crystallinity; in order to increase the concentration of the minor phase in the amorphous major phase.

It is to be understood that conventional additives such as nucleating agents and antioxidants may be added into the composite material or in the major phase of minor phase materials in the amount of about 0.01% by weight to about 5% by weight without departing from the spirit and scope of the invention. Exemplary nucleating agents are talc, silica, mica, and kaolin. Examples of antioxidants are: hindered phenols such as tetrakis[methylene (3,5-di-tert-butyl-4-hydroxyhydrocinnamate)]-methane, bis[(beta-(3,5-diter-butyl4-hydroxybenzyl)methylcarboxyethyl)]sulphide, 4,4-thiobis(2-methyl-6-tert-butylphenol), 4,4-thiobis(2-tert-butyl-5-methylphenol), 2,2-thiobis(4-methyl-6-tert-butylphenol), and thiodethylene bis(3,5-di-tert-butyl-4-hydroxy)hydrocinnamate; phosphites and phosphonites such as tris(2,4-di-tert-butylphenyl)phosphite and di-tert-butylphenylphosphonitie; thio compounds such as dilaurylthiodipropionte, dimyristylthiodipropionate, and disterylthiodipropionate; various siloxanes; and various arines such as polymerized 2,2,4-trimethyl-1,2-dihydroquinoline.

While various embodiments of the invention have been shown and described, it is to be understood that the above-described embodiments are merely illustrative of the invention and other embodiments may be devised by those skilled in the art which will embody the principles of the invention and fall within the spirit and scope thereof.

What is claimed is:

1. A semiconductive jacket material for jacketing a cable, comprising:

a minor phase material comprising a semicrystalline polymer;

a conductive filler material dispersed in and residing in said minor phase material in an amount of about 10% by weight or less to form a binary composite; and a major phase material, said major phase material being a polymer which when mixed with said binary composite forms a ternary composite of an immiscible polymer blend, said major phase material having said binary composite dispersed therein in an amount sufficient to be equal to or greater than an amount required to generate a continuous conductive network in said major phase material, said ternary composite being free of hydrogen bonding and having co-continuous distinct phases, a volume resistivity of about $\leqq 100\Omega\cdot m$, an unaged tensile strength of at least about 1200 psi, a tensile strength of at least about 75% of said unaged tensile strength after aging in an air oven at 100° C. for 48 hours, an aged and unaged elongation at break of at least about 100%, a heat distortion at 90° C. of at least about −25%, and a brittleness temperature of about $\leqq -10°$ C.

2. The semiconductive jacket material of claim 1, wherein said conductive filler material is selected from the group consisting of carbon black, graphite, metallic particles, intrinsically conductive polymers, carbon fibers, and mixtures thereof.

3. The semiconductive jacket material of claim 1, wherein said minor phase material is a semicrystalline polymer having a crystallinity from about 30% to about 80%.

4. The semiconductive jacket material of claim 1, wherein said semicrystalline polymer is high density polyethylene with a crystallinity of about $\geqq 70\%$.

5. The semiconductive jacket material of claim 1, wherein said major phase material is comprised of a poly(ethylene-co-vinyl acetate).

6. The semiconductive jacket material of claim 5, wherein said poly(ethylene-co-vinyl acetate) has a vinyl acetate content of greater than about 40% by weight and said minor phase material with conductive filler material dispersed therein comprising about 50% by weight of said ternary composite.

7. The semiconductive jacket material of claim 5, wherein said poly(ethylene-co-vinyl acetate) has a vinyl acetate content of less than about 40% by weight.

8. The semiconductive jacket material of claim 1, wherein said minor phase material has a solubility parameter $\delta_A$, said major phase material has a solubility parameter $\delta_B$, and said ternary composite meets the following criteria for immiscibility, $7 \geqq (\delta_A - \delta_B)^2 \geqq 0$.

9. The semiconductive jacket material of claim 1, wherein said semicrystalline polymer high density polyethylene of crystallinity of $\geqq 70\%$, said major phase material is a poly (ethylene-co-vinyl acetate) with vinyl acetate content of less than about 40%, and said conductive filler material is selected from the group consisting of carbon black, graphite, metallic particles, intrinsically conductive polymers, carbon fibers, and mixtures thereof.

10. The semiconductive jacket material of claim 1, further comprising:

a second major phase material, wherein said ternary composite is dispersed in an amount sufficient for said ternary composite to be continuous within said second major phase material, said second major phase material being selected from a group of polymers which when mixed with said ternary composite forms a quaternary composite of an immiscible polymer blend having co-continuous distinct phases.

11. The semiconductive jacket material of claim 1, further comprising a material selected from the group consisting of an antioxidant, a nucleating agent, and mixtures thereof.

12. A semiconductive jacket material for jacketing a cable, comprising:

a minor phase material comprising a semicrystalline polymer having a crystallinity from about 30% to about 80%;

a conductive filler material dispersed in and residing in said minor phase material in an amount of about 10% by weight or less to form a binary composite; and a major phase material, said major phase material being a polymer which when mixed with said binary composite forms a ternary composite of an immiscible polymer blend, said major phase material having said binary composite dispersed therein in an amount sufficient to be equal to or greater than an amount required to generate a continuous conductive network in said major phase material, said ternary composite being free of hydrogen bonding and having co-continuous distinct phases.

13. A semiconductive jacket material for jacketing a cable, comprising:

a minor phase material comprising a semicrystalline polymer;

a conductive filler material dispersed in and residing in said minor phase material in an amount of about 10% by weight or less to form a binary composite;

a major phase material, said major phase material being a polymer which when mixed with said binary composite forms a ternary composite of an immiscible polymer blend, said major phase material having said binary composite dispersed therein in an amount sufficient to be equal to or greater than an amount required to generate a continuous conductive network in said major phase material, said ternary composite being free of hydrogen bonding and having co-continuous distinct phases; and a second major phase material, wherein said ternary composite is dispersed in an amount sufficient for said ternary composite to be continuous within said second major phase material; said second major phase material being selected from a group of polymers which when mixed with said ternary composite forms a quaternary composite of an immiscible polymer blend having co-continuous distinct phases.

14. A semiconductive jacket material for jacketing a cable, comprising:

a minor phase material comprising a semicrystalline polymer;

a conductive filler material dispersed in and residing in said minor phase material in an amount of about 10% by weight or less to form a binary composite; and a major phase material, said major phase material being a polymer which when mixed with said binary composite forms a ternary composite of an immiscible polymer blend, said major phase material having said binary composite dispersed therein in an amount sufficient to be equal to or greater than an amount required to generate a continuous conductive network in said major phase material, said ternary composite being free of hydrogen bonding and having co-continuous distinct phases wherein said minor phase material has a solubility parameter $\delta_A$, said major phase material has a solubility parameter $\delta_B$, and said ternary composite meets the following criteria for immiscibility, $7 \geqq (\delta_A - \delta_b)^2 \geqq 0$.

15. A semiconductive jacket material for jacketing a cable, comprising:

a minor phase material comprising a semicrystalline polymer;

metallic particles dispersed in and residing in said minor phase material in an amount of about 85% by weight or greater to form a binary composite; and a major phase material, said major phase material being a polymer which when mixed with said binary composite forms a ternary composite of an immiscible polymer blend, said major phase material having said binary composite dispersed therein in an amount sufficient to be equal to or greater than an amount required to generate a continuous conductive network in said major phase material, said ternary composite being free of hydrogen bonding and having co-continuous distinct phases, a volume resistivity of about $\leqq 100\Omega\cdot m$, an unaged tensile strength of at least about 1200 psi, a tensile strength of at least about 75% of said unaged tensile strength after aging in an air oven at 100° C. for 48 hours, an aged and unaged elongation at break of at least about 100%, a heat distortion at 90° C. of at least about −25%, and a brittleness temperature of about ≦−10° C.

16. A semiconductive jacket material for jacketing a cable, comprising:

a minor phase material comprising a semicrystalline polymer selected from the group consisting of high density polyethylene, polypropylene, polypropene, poly-1-butene, poly(styrene), polycarbonate, poly(ethylene terephthalate), polyethylene, nylon 66 and nylon 6;

a conductive filler material selected from the group consisting of carbon black, polyacetylene, polyaniline, polypyrrole, graphite and carbon fibers, dispersed in and residing in said minor phase material in an amount of about 10% by weight or less to form a binary composite; and a major phase material selected from the group consisting of poly(ethylene-co-vinyl acetate), polybutylene terephthalate, poly(styrene), poly (methyl methacrylate), polyethylene, polypropylene, polyisobutylene, poly(vinyl chloride), poly(vinylidene chloride), poly(tetrafluoroethylene), poly(vinyl acetate), poly(methyl acrylate), polyacrylonitrile, polybutadiene, poly(ethylene terephthalate), poly(8-aminocaprylic acid) and poly(hexamethylene adipamide), said major phase material which when mixed with said binary composite forms a ternary composite of an immiscible polymer blend, said major phase material having said binary composite dispersed therein in an amount sufficient to be equal to or greater than an amount required to generate a continuous conductive network in said major phase material, said ternary composite being free of hydrogen bonding and having co-continuous distinct phases, a volume resistivity of about $\leqq 100\Omega\cdot m$, an unaged tensile strength of at least about 1200 psi, a tensile strength of at least about 75% of said unaged tensile strength after aging in an air oven at 100° C. for 48 hours, an aged and unaged elongation at break of at least 100%, a heat distortion at 90° C. of at least about −25%, and a brittleness temperature of about ≦−10° C.

17. A cable comprising at least one transmission medium and a semiconductive jacket surrounding said transmission medium, said semiconductive jacket comprising:

a minor phase material comprising a semicrystalline polymer;

a conductive filler material dispersed in and residing in said minor phase material in an amount of about 10% by weight or less to form a binary composite; and a major phase material, said major phase material being a polymer which when mixed with said binary composite forms a ternary composite of an immiscible polymer blend, said major phase material having said binary composite dispersed therein in an amount sufficient to be equal to or greater than an amount required to generate a continuous conductive network in said major phase material, said ternary composite being free of hydrogen bonding and having distinct co-continuous phases, a volume resistivity of about $\leqq 100\Omega\cdot m$, an unaged tensile strength of at least about 1200 psi, a tensile strength of at least about 75% of said unaged tensile strength after aging in an air oven at 100° C. for 48 hours, an aged and unaged elongation at break of at least about 100%, a heat distortion at 90° C. of at least about −25%, and a brittleness temperature of about $\leqq -10°$ C.

18. The cable of claim 17, wherein said transmission medium is an electrical conductor.

19. The cable of claim 18, further comprising:

a semiconductive conductor shield overlying said electrical conductor;

a layer of insulation surrounding said semiconductive conductor shield;

an insulation shield overlying said layer of insulation;

a layer of electrical shielding around said insulation shield, said layer of electrical shielding being surrounded by said semiconductive jacket.

20. The cable of claim 17, wherein said transmission medium is an optical fiber.

21. The cable of claim 17, wherein said semicrystalline polymer is high density polyethylene of crystallinity of $\geqq 70\%$; said major phase material is a poly(ethylene-co-vinyl acetate) with vinyl acetate content of less than about 40%; and said conductive filler material is selected from the group consisting of carbon black, graphite, metallic particles, intrinsically conductive polymers, carbon fibers and mixtures thereof.

22. The cable of claim 17, wherein said semicrystalline polymer is high density polyethylene of $\geqq 70\%$; said major phase material is a poly(ethylene-co-vinyl acetate) with vinyl acetate content of greater than about 40%; said conductive filler material is selected from the group consisting of carbon black, graphite, metallic particles, intrinsically conductive polymers, carbon fibers and mixtures thereof, and said minor phase material with conductive filler dispersed therein comprises about 50% of said ternary composite.

23. The cable of claim 17, wherein said minor phase material has a solubility parameter $\delta_A$, said major phase material has a solubility parameter $\delta_B$, and said ternary composite meets the following criteria for immiscibility, $7 \geqq (\delta_A - \delta_B)^2 \geqq 0$.

24. The cable of claim 17, wherein said semiconductive jacket further comprises a material selected from the group consisting of an antioxidant, a nucleating agent, and mixtures thereof.

25. A cable comprising at least one transmission medium and a semiconductive jacket surrounding said transmission medium, said semiconductive jacket comprising:

a minor-phase material comprising a semicrystalline polymer;

a conductive filler material dispersed in and residing in said minor phase material in an amount of about 10% by weight or less to form a binary composite; and a major phase material, said major phase material being a polymer which when mixed with said binary composite forms a ternary composite of an immiscible polymer blend, said major phase material having said binary composite dispersed therein in an amount sufficient to be equal to or greater than an amount required to generate a continuous conductive network in said major phase material, said ternary composite being free of hydrogen bonding and having distinct co-continuous phases, a solubility parameter $\delta_A$, said major phase material has a solubility parameter $\delta_B$, and said ternary composite meets the following criteria for immiscibility, $7 \geqq (\delta_A - \delta_B)^2 \geqq 0$.

* * * * *

UNITED STATES PATENT AND TRADEMARK OFFICE

CERTIFICATE OF CORRECTION

PATENT NO. : 6,506,492 B1
DATED : January 14, 2003
INVENTOR(S) : Foulger

It is certified that error appears in the above-identified patent and that said Letters Patent is hereby corrected as shown below:

Column 3,
Line 40, cancel the period "." after "weight"

Column 12,
Line 66, cancel "JO"

Column 17,
Line 52, change "arines" to -- amines --

Column 18,
Line 46, after "polymer" insert -- is --

Signed and Sealed this

Twenty-ninth Day of July, 2003

JAMES E. ROGAN
*Director of the United States Patent and Trademark Office*